United States Patent [19]

Keim

[11] Patent Number: 4,936,352

[45] Date of Patent: Jun. 26, 1990

[54] DOUBLE LIFT OPEN SHED JACQUARD MACHINE

[75] Inventor: Walter Keim, Senden, Fed. Rep. of Germany

[73] Assignee: Grosse Weberimaschinen GmbH, Neu-Ulm/Burlafingen, Fed. Rep. of Germany

[21] Appl. No.: 214,498

[22] Filed: Jul. 1, 1988

[30] Foreign Application Priority Data

Jul. 2, 1987 [DE] Fed. Rep. of Germany ..... 3721932

[51] Int. Cl.[5] ..... D03C 3/08; D03C 3/36

[52] U.S. Cl. ..... 139/65; 139/59

[58] Field of Search ..... 139/65, 59, 60, 61, 139/62, 63, 64

[56] References Cited

U.S. PATENT DOCUMENTS 4,532,963 8/1985 Bastion et al. ..... 139/59

FOREIGN PATENT DOCUMENTS 1535220 12/1970 Fed. Rep. of Germany ..... 139/59
2507487 11/1976 Fed. Rep. of Germany .
2533216 7/1977 Fed. Rep. of Germany .
2047755 12/1980 United Kingdom ..... 139/65

*Primary Examiner*—Andrew M. Falik
*Attorney, Agent, or Firm*—Scully, Scott, Murphy & Presser

[57] ABSTRACT

A double lift, open shed Jacquard machine in which the lifting knives of two sets of lifting knives which are to be moved in opposite directions are linked at their ends to oscillating shafts by lever arrangements. The oscillating shafts are mounted in the machine frame and are pivoted via a form-locking connection to the eccentric of an eccentric gear. The rotating shaft of the eccentric gear is coupled with a driving motor. The oscillating shafts can be mounted by supports along their length in the machine frame. In this manner the masses to be moved can be substantially reduced with a simple constructional design and furthermore assembly is facilitated.

12 Claims, 1 Drawing Sheet

DOUBLE LIFT OPEN SHED JACQUARD MACHINE

TECHNICAL FIELD OF THE INVENTION

The invention relates to a double lift, open shed Jacquard machine having a machine frame, and with two sets of lifting knives arranged alternately so as to be movable counter to each other in the machine frame between two shed positions.

BACKGROUND OF THE INVENTION AND PRIOR ART

A variety of Jacquard machines of this type are known. In the case of Jacquard machines of this kind, various designs have appeared in the last few years by means of which the working speed, i.e. the number of changes in the shed positions per unit time, can be increased. Changes in the shed positions occur by the movement of lifting knives from a lower shed position to an upper shed position With pattern controlled, i.e. optional, entrainment or non-entrainment of the hooks. The lifting knives of a set of lifting knives are conventionally arranged in a respective knife frame or beam which is moved by means of a drive between the two positions, generally up and down, as a result of which there is an exceptionally high strain and thus much wear during the whole of the shed stroke. The arrangement of beams, knives and drives must therefore be very rigid and is thus very heavy. As a result, working at high speeds (high speeds of the driving motor) can lead to vibrations. Furthermore, the two knife frames or knife beams have to be moved in opposite directions without interfering with one another. Due to this, additional construction difficulties arise.

These disadvantages are not only present in Jacquard machines of conventional design in which the lifting knives move in the direction of the weft thread, but also in Jacquard machines in which the lifting knives move in the direction of the warp thread (cf. DE-PS 25 33 216). In the latter case the additional disadvantage arises that when forming a diagonal shed and with the use of a common drive there are various points of engagement, so that the loads at high operating speeds produce even more unfavorable effects owing to their varied distribution.

OBJECT OF THE INVENTION

On this basis, it is the object of the invention to design a double lift open shed Jacquard machine of the kind pursuant to the field of invention, so that with a more practical construction the size of the machine is reduced.

SUMMARY OF THE INVENTION

In the present invention it is important to provide an oscillating shaft to which the lifting knives of a set of lifting knives can be linked individually, whereby individual adjustment and simple individual exchange is possible. The oscillating shaft itself is moved by a relatively simple drive which causes the oscillating movement. It is of great importance that the parts effecting the movement of the lifting knives are no longer arranged in a heavy frame but are linked to an oscillating shaft which can be supported in the frame of the machine. Particularly if oscillating shafts are provided on both sides of the Jacquard machine, i.e. arranged at both ends of the lifting knives, Jacquard machines having very large dimensions can be made, since the oscillating shafts can be supported in a simple manner and the knives can also be relatively long since they can be mounted lengthways in the frame of the machine so as to avoid buckling or bending. The arrangement according to the invention also enables simple maintenance as well as setting, since to alter the shed lift it is only necessary to change the drive, preferably by merely exchanging an eccentric, and fine adjustment only requires displacement in a part of a clamping device holding the lifting knives.

BRIEF DESCRIPTION OF THE DRAWINGS

The invention will be described in more detail with reference to an exemplary embodiment shown in the drawings, in which.

DETAILED DESCRIPTION OF A PREFERRED EMBODIMENT OF THE INVENTION

The invention will be described with reference to a double lift open shed Jacquard machine having lifting knives moving in the direction of the warp threads and forming a diagonal shed. However, the invention can also be used in Jacquard machines in which the lifting knives move in the direction of the weft thread and in which the shed formed is not diagonal but straight; hence in any Jacquard machine in which the two sets of lifting knives are moved between two shed positions and neither the nature of the engagement between the lifting knives and hooks nor whether the hooks are controlled in the upper shed position or the lower shed position is important.

Figure 1:
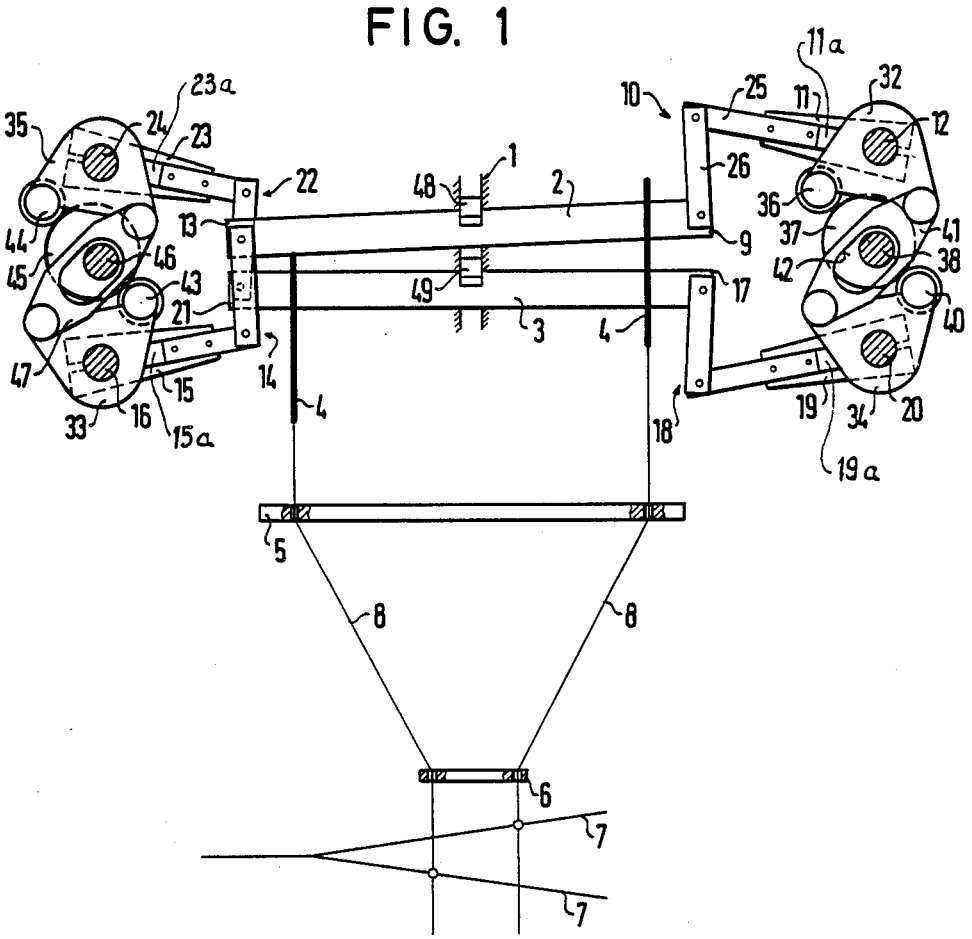
FIG. 1 shows in side view, without the machine frame, the basic arrangement of the Jacquard machine according to the invention.

Arranged in a machine frame 1, which is not shown in FIG. 1 and which can be connected to the remainder of the loom, are two sets of lifting knives 2 and 3 which are to be moved between an upper shed position and a lower shed position. In one of the two shed positions it is determined by means of a control arrangement (not shown) whether or not any given hook 4 is to be carried to the other shed position by the respective lifting knife 2 or 3. Control arrangements of this kind are well known; they can either be mechanical or electromechanical. In the lower shed position, the hooks 4 can rest on a bottom board 5 shown diagrammatically. Each hook 4 is connected to a harness cord 8 which is guided over a comber board 6 and is held suitably resiliently (harness back tension). These cords 8 are connected to the respective warp threads 7 in the usual way.

Over the width of the Jacquard machine or the machine frame 1 the lifting knives 2 of the first set and the lifting knives 3 of the second set are each arranged roughly parallel to one another and are offset relative to the respective lifting knives 3, 2 of the other set. The lifting knives 2, 3 are substantially flat blade parts, which are provided with notches, recesses or the like, with which the hooks 4 can be carried along by means of nebs or the like provided the hooks are not moved out of the path of movement of the lifting knives 2, 3 by the control arrangement (not shown).

Each lifting knife is connected at its ends by a respective lever arrangement to a moving device common to all the lifting knives of the same set.

The right end 9 of the lifting knife 2 in FIG. 1 is connected by a lever arrangement 10 to a clamping device 11 which is fixed to an oscillating shaft 12. The left end 13 of the lifting knife 2 in FIG. 1 is connected by a lever arrangement 14 to a clamping device 15 which is fixed to an oscillating shaft 16.

The right end 17 of the lifting knife 3 of the other lifting knife set is connected by a lever arrangement 18 to a clamping device 19 which is fixed to an oscillating shaft 20. The left end 21 of this lifting knife 3 is connected by a lever arrangement 22 to a clamping device 23 which is fixed to an oscillating shaft 24.

Each set of lifting knives is thus connected at both ends by a respective set of lever arrangements to a pair of oscillating shafts so that a rotational movement of the oscillating shafts creates a corresponding lifting movement of the lifting knives.

In order to obtain a uniformly stable position for all the lifting knives 2, 3, the respective lifting knife 2, 3 and the respective lever arrangement 10, 14; 18, 22, arranged at its ends, are connected so that each lifting knife is suspended from a lever arrangement at one end and at the other end is supported above the lever arrangement associated therewith, i.e. so that the oscillating shafts associated with the one lifting knife 2, 3 or lifting knife set, namely in the one case 12 and 16 and in the other case 20 and 24, are arranged crosswise.

In order to transfer the oscillating movement of the respective oscillating shaft 12, 16, 20, 24 as a lifting movement to the respective lifting knife 2, 3, the lever arrangement in the exemplary embodiment is formed of two parts, as will be explained with reference to the lever arrangement 10. This comprises a first lever arm 25 connected to the clamping device 11 and a second lever arm 26 which at one end is pivotably attached to the right end 9 of the lifting knife 2 and at the other end is pivotably attached to the free end of the first lever arm 25. If the second lever arms of the two lever arrangements associated with one lifting knife are of such a size so that the lifting knives run substantially parallel to one another (e.g.) are arranged horizontally, a straight shed formation is obtained. However, if the measurements are chosen to be such as those in the exemplary embodiment, a diagonal shed formation is obtained. As explained, each first lever arm of the lever arrangement is fixed in the respective clamping device. If this attachment is made adjustable in the direction of reach of the lever arm a fine adjustment of the shed lift can be achieved. Hereby, for this purpose, the clamping devices 11, 15, 19 an 23 each are provided with, respectively, elongate central grooves or cutouts **11*a*, 15*a*, 19*a* and 23*a* for slidingly receiving therein the end portions of the first lever arm 25 of the lever arrangement associated therewith. The respective lever arms 25 may then be clamped into the applicable groove by tightening suitable clamping screws (not shown) arranged on the clamping devices. It has been found that adjustments of about 5** mm are possible.

Figure 2:
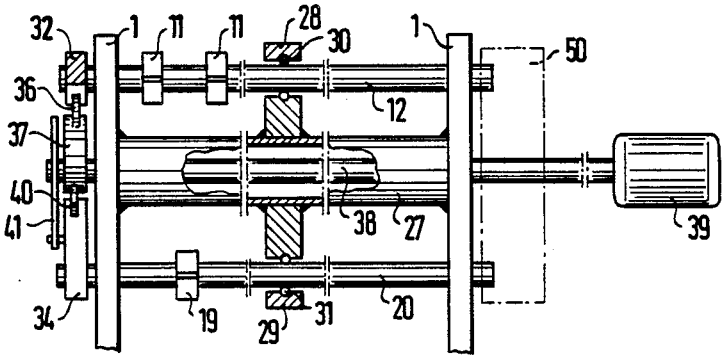
FIG. 2 shows a simplified front view of the association of the Jacquard machine of FIG. 1 with the machine frame.

As shown in FIG. 2, both the oscillating shafts 12, 20, and the two other oscillating shafts 16, 24 not shown in FIG. 2, are mounted in the machine frame 1 and support the respective lifting knives merely by means of the clamping devices 11, 19 (or 23, 15) and the respective lever arrangements. If the lengths of the oscillating shafts 12, 20 are suitable, these can be supported on the machine frame 1 by a supporting device. In the exemplary embodiment according to FIG. 2 a supporting tube 27 is connected to the machine frame 1, in particular by welding: mounted on, e.g. welded to, the periphery of the supporting tube 27 are supports 28 and 29 which hold the oscillating shafts 12 and 20 respectively in bearings 30 and 31, shown diagrammatically. Several supports of this kind can be distributed over the length of the oscillating shaft 12, 20 (or 16, 24). By this means, the respective oscillating shaft is prevented from bending.

In FIG. 2 the displacement of the lifting knives 2, 3 of the two sets of lifting knife is indicated diagrammatically.

Attached to each end of each of the oscillating shafts 12, 16, 20, 24, projecting from the machine frame 1, is a respective carrier 32, 33, 34, 35. Each carrier is substantially U-shaped and is connected in the middle to the respective oscillating shaft. Each carrier carries on one limb, as will be explained with reference to the carrier 32, a follower roller 36 which bears on an eccentric 37 which is fixed to a rotating shaft 38. The rotating shaft 38 is connected to the driving motor 39 of the loom, advantageously through a gearing arrangement (not shown). The eccentric 37 is preferably mounted on shaft 38 so that it can be exchanged for a differently sized or configured eccentric in order to change the pattern produced by the machine. By suitable selection of the dimensions of the eccentrics 37 a variety of shed lifts are possible as a coarse adjustment, and by exchanging the eccentric 37 can be redetermined for each individual case. Therefore, it is also advantageous if, as shown in FIG. 2, the rotating shaft 38 is mounted in the machine frame 1 and, as shown, passes through the supporting tube 27. This provides easy access to the eccentric 37 and to the parts outside the machine frame 1 associated with the oscillating shafts 12, 20.

Now, each oscillating shaft can be associated with an individual eccentric having a rotating shaft coupled with the driving motor 39. However, it is advantageous, as shown in the exemplary embodiment, if the follower roller 40 on the carrier 34 also bears on the eccentric 37 in such a way that when the lifting knives of the one lifting knife set have reached the upper shed position by means of the engagement between the follower roller and the eccentric, the lifting knives of the other lifting knife set have then reached the lower shed position and vice versa. In the exemplary embodiment the shape of the eccentric 37 and the arrangement of the follower rollers 36, 40 is such that with one rotation of the rotating shaft 38 a complete lift is carried out, namely that each lifting knife 2, 3 reaches both shed positions once. For this purpose, the two follower rollers 36, 40 are offset by 180° relative to the rotating shaft 38.

Furthermore, the respective other limbs of the supports 32, 34 are connected to one another by a link 41 hinged to these limbs and having a slot 42 embracing the rotating shaft 38. In this manner, the follower rollers 36, 40 automatically bear on the eccentric through a form-locking connection.

The two other oscillating shafts 16, 24 also bear in a form-locking manner on an eccentric 45 of a rotating shaft 46 in an almost identical way by means of follower rollers 43, 44, said shaft 46 also being coupled to the driving motor 39, for example, by means of belt drive or the like. This belt drive can make the connection with the rotating shaft 38 which for its part is coupled with the driving motor 39. Here too a link 47 is provided which effects the form-locking bearing.

In the simplest case, when forming a diagonal shed, one of the two eccentric gearing arrangements can be replaced by a simple bearing in the frame whereby, however, it must be ensured by adapting the length of the lifting knives that the minimum lift necessary for all the hooks is achieved. For this reason the arrangement chosen is preferred since, by this means, the knives can be shorter.

The arrangement shown ensures reliable synchronization of the movements, in particular the movement of the lifting knives 2 and 3 into their two respective shed positions. However, a different gearing arrangement effecting this synchronization can also be used.

If the oscillating shafts 12, 16, 20, 24 are particularly long, a comparable gearing arrangement 50, indicated by broken lines in FIG. 2, can also be provided on the other side of the machine frame 1, which substantially corresponds to the gearing arrangement shown on the left side in FIG. 2. However, its disassembly and exchangeability is made more difficult since the connection to the driving motor 39 is effected on this side.

In addition, FIG. 1 shows that each lifting knife 2 and 3 has a respective guide 48, 49 associated with it which can be moved within longitudinal slots or guiding recesses as shown in frame 1 in FIG. 1 formed in the supporting side plates of the machine frame 1 indicated in this respect in the same direction as the lifting knives 2, 3. These guides 48, 49 are preferably located centrally relative to the points of engagement of the hooks 4 and the lifting knives 2, 3. By means of these guides 48, 49, the knives 2, 3 are on the one hand prevented from buckling or bending out of the plane of the drawing corresponding to FIG. 1, and on the other hand a displacement of the lifting knives 2, 3 lengthways and parallel to the plane of the drawing is prevented, thus preventing the hooks 4 from bending or pivoting too much.

The design of the Jacquard machine according to the invention makes it possible to restrict the movement almost entirely to the lifting knives, so that the mass to be moved is reduced to a minimum. Furthermore, the oscillating shaft can also be supported so as to prevent bending. In this manner, the load on the driving arrangement is reduced considerably. Substantially all rotating parts are used which can easily be mounted in the machine frame, which simplifies the construction considerably. Moreover, the constructional design is simplified and easy adjustment is possible.

What is claimed is:

1. In a double lift, open shed Jacquard machine having a machine frame, sets of lifting knives arranged alternately and so as to be movable counter to one another in the machine frame between two shed positions, hooks mounted in the machine frame which are pattern controlled and are selectively entrained by a respective one of the lifting knives, and having a driving arrangement to move the sets of lifting knives, with different weaving widths being obtainable by correspondingly changing the number of moved lifting knives of always the same length; the improvement comprising: the lifting knives of each set of lifting knives being linked to at least respectively one oscillating shaft; an eccentric gear unit having a rotating shaft rotatable by the driving arrangement, and an eccentric of said gear unit pivoting the respective oscillating shaft by bearing on a follower roller means non-rotatably secured to said respective oscillating shaft, the oscillating shafts being mounted in the machine frame at right angles to the reach of the lifting knives and to the direction of movement of the lifting knives, the length of the oscillating shafts being dimensioned such that a number of sets of lifting knives corresponding to a maximum weaving path is linkable thereto.

2. A Jacquard machine according to claim 1, wherein a lever arrangement links the lifting knives of each set of lifting knives at an opposite end of each of said knives to said respective oscillating shaft.

3. A Jacquard machine according to claim 2, characterized in said oscillating shafts associated with a respective set of said lifting knives are arranged in parallel in the machine frame relative to those of the other set of lifting knives such that each lifting knife is linked to the respective oscillating shaft with one end being suspended and the other end being supported.

4. A Jacquard machine according to claim 1, wherein the follower roller means of one oscillating shaft of each of the sets of lifting knives bear in common on said eccentric so as to effectuate the counter movement.

5. A Jacquard machine according to claim 4, wherein supports for the follower roller means are connected to one another pairs on the respective oscillating shafts through a link encompassing the respective rotating shaft.

6. A Jacquard machine according to claim 1, wherein the rotatable shaft passes through the machine frame so as to be mounted therein; a supporting tube fixed in the machine frame encompasses said shaft.

7. A Jacquard machine according to claim 6, wherein the respective oscillating shaft is mounted along its length in supports which are rigidly fixed to the machine frame so as to prevent bending of the shaft.

8. A Jacquard machine according to claim 1, wherein the ends of a lever arrangement connecting each said lifting knife with an associated oscillating shaft are secured in a clamping device connected to the oscillating shaft for adjustment at right angles relative to the axis of the shaft for adjustment of the displacements of the knife between shed positions.

9. A Jacquard machine according to claim 1, wherein one said eccentric gear unit having the eccentric thereof engaging respectively each end of the oscillating shafts, said gear units being driven in synchronism with one another and being mounted on the same rotatable shaft.

10. A Jacquard machine according to claim 1, wherein the oscillating shafts are pivotable through a pivot angle of within about 20 to 30°.

11. A Jacquard machine according to claim 1, comprising a guide along the length of each lifting knife which slides within the machine frame.

12. A Jacquard machine according to claim 11, wherein the guide is arranged substantially centrally in the frame.

* * * * *

UNITED STATES PATENT AND TRADEMARK OFFICE

CERTIFICATE OF CORRECTION

PATENT NO. : 4,936,352

DATED : June 26, 1990

INVENTOR(S) : Walter Keim

It is certified that error appears in the above-identified patent and that said Letters Patent is hereby corrected as shown below:

On the title page under Section [73 "Weberimaschinen" should read as --Webereimaschinen--

Column 1, line 21: "With" should read as --with--

Column 1, line 51: "field of invention" should read as --field of the invention--

Column 6, line 31, Claim 5: "another pairs" should read as --another in pairs--

Signed and Sealed this

Twenty-seventh Day of August, 1991

*Attest:*

*Attesting Officer*

HARRY F. MANBECK, JR.

*Commissioner of Patents and Trademarks*